United States Patent [19]

Manders

[11] Patent Number: 4,669,514

[45] Date of Patent: Jun. 2, 1987

[54] AIR JET WEAVING MACHINE AND WEFT INSERTION NOZZLE ARRANGEMENT IN SUCH AIR JET WEAVING MACHINE

[75] Inventor: Petrus G. J. Manders, MS Eindhoven, Netherlands

[73] Assignee: Gebrüder Sulzer Aktiengesellschaft, Winterthur, Switzerland

[21] Appl. No.: 733,462

[22] Filed: May 13, 1985

[30] Foreign Application Priority Data

May 21, 1984 [EP] European Pat. Off. ..... 84810244

[51] Int. Cl.[4] ..... D03D 47/28

[52] U.S. Cl. ..... 139/435

[58] Field of Search ..... 139/435; 226/97

[56] References Cited

U.S. PATENT DOCUMENTS

| | | | |
|---|---|---|---|
| 3,685,553 | 8/1972 | Sakamoto | 139/435 |
| 4,081,000 | 3/1978 | Wollenmann | 139/435 |
| 4,436,122 | 3/1984 | Mullekom . | |
| 4,552,188 | 11/1985 | Kuda et al. | 139/435 |

FOREIGN PATENT DOCUMENTS

| | | | |
|---|---|---|---|
| 1535454 | 8/1969 | Fed. Rep. of Germany | 139/435 |
| 47-46625 | 11/1972 | Japan | 139/435 |
| 183135 | 8/1966 | U.S.S.R. . | |

*Primary Examiner*—Henry S. Jaudon

*Attorney, Agent, or Firm*—Werner W. Kleeman

[57] ABSTRACT

In the weft insertion nozzle arrangement containing at least two weft insertion nozzles the mixing tube of one weft insertion nozzle is set with its outflow or discharge end of end region parallel to a weft insertion line. The outflow or discharge end or end region of the mixing tube associated with the other weft insertion nozzle is set at a small angle of about 3° relative to the weft insertion line. The entire weft insertion nozzle arrangement is fixedly mounted at a weaving machine member carrying such weft insertion nozzle arrangement. Movable control members for displacing the weft insertion nozzles and faulty operations associated therewith are thus eliminated. Tests have shown that the weft insertion can be reliably accomplished even when the mixing tube of the other weft insertion nozzle is set at such small angle of inclination relative to the weft insertion line.

14 Claims, 7 Drawing Figures

AIR JET WEAVING MACHINE AND WEFT INSERTION NOZZLE ARRANGEMENT IN SUCH AIR JET WEAVING MACHINE

BACKGROUND OF THE INVENTION

The present invention relates to a new and improved construction of a weft insertion nozzle arrangement in an air jet weaving machine. The present invention also relates to a new and improved construction of an air jet weaving machine containing such new and improved weft insertion nozzle arrangement.

In its more particular aspects the present invention specifically relates to a new and improved construction of a weft insertion nozzle arrangement containing at least two weft insertion nozzles which are arranged at an air jet weaving machine member outside the weaving shed and which are selectively activatable in accordance with a predetermined weft insertion program.

In an arrangement of this type as known, for example, from U.S. Pat. No. 4,326,565, granted Apr. 27, 1982, and the cognate German Patent Publication No. 3,014,766 and British Patent Application No. 2,047,286, published Nov. 26, 1980, a double or twin weft insertion nozzle arrangement is pivotably arranged at a batten or sley of the air jet weaving machine. Control means are provided in order to pivot a selected one of the weft insertion nozzles with its air outflow or discharge tube into the weft insertion line when the weft thread associated therewith is required to be inserted during the following weft insertion operation.

At high weft insertion rates like, for example, 400 or more weft insertions per minute, there may occur a condition at which the pivoting of the weft insertion nozzles is not sufficiently rapidly performed prior to the next required momentary weft insertion operation. Also, malfunctions may develop at the movable components of the pivoting means.

SUMMARY OF THE INVENTION

Therefore, with the foregoing in mind it is a primary object of the invention to provide a new and improved construction of a weft insertion nozzle arrangement in an air jet weaving machine which is not afflicted with the drawbacks and limitations of prior art constructions heretofore discussed.

A more specific object of the present invention is directed to a new and improved construction of a weft insertion nozzle arrangement in an air jet weaving machine which is free of any operational faults due to malfunction of pivotably movable components associated with the weft insertion operation.

Now in order to implement these and still further objects of the invention, which will become more readily apparent as the description proceeds, the weft insertion nozzle arrangement in the air jet weaving machine of the present development is manifested by the features that, the at least two weft insertion nozzles are fixedly mounted at the weaving machine member carrying the weft insertion nozzle arrangement and that one of the at least two weft insertion nozzles, at least in a weft insertion position of components of the weft insertion nozzle arrangement, is set or positioned substantially parallel in relation to a weft insertion line and that the other one of the at least two weft insertion nozzles is set or positioned at a small angle of inclination, for example, in the range of about 1° to about 5° relative to the weft insertion line.

Due to such arrangement there can be achieved the result that the movable or pivotable arrangement of the multiple weft insertion nozzles can be totally dispensed with. The weft insertion nozzles neither need be pivoted, nor need they be axially parallelly displaced during operation. The weft insertion nozzle arrangement, therefore, can be readily used for any desired high weft insertion rates of the air jet weaving machine. Movable or pivotable parts or members as well as associated control means for moving or pivoting the weft insertion nozzles prior to the weft insertion operation are thus eliminated.

The invention is based on the recognition that it is possible as a result of tests to permanently install one of the at least two weft insertion nozzles, preferably parallel to the weft insertion line, and the other one of the at least two weft insertion nozzles at a certain small inclination angle of, for example, about 3° relative to the weft insertion line. Consequently, the two weft insertion nozzles are not required to be moved or pivoted during operation relative to the weft insertion line, relative to the reed or relative to other guide means for the air jet like, for example, guide teeth. The small angle of inclination of this other or second weft insertion nozzle relative to the one or first weft insertion nozzle specifically is possible when the other or second weft insertion nozzle blows air at a small angle towards the reed and particularly not away therefrom. There can be employed, for example, a so-called tunnel or channel reed, which is also called a profiled reed. The tunnel or channel of such type of reed is formed by the profiled structure of the lamellae from which the reed is composed, as is well known in the art.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
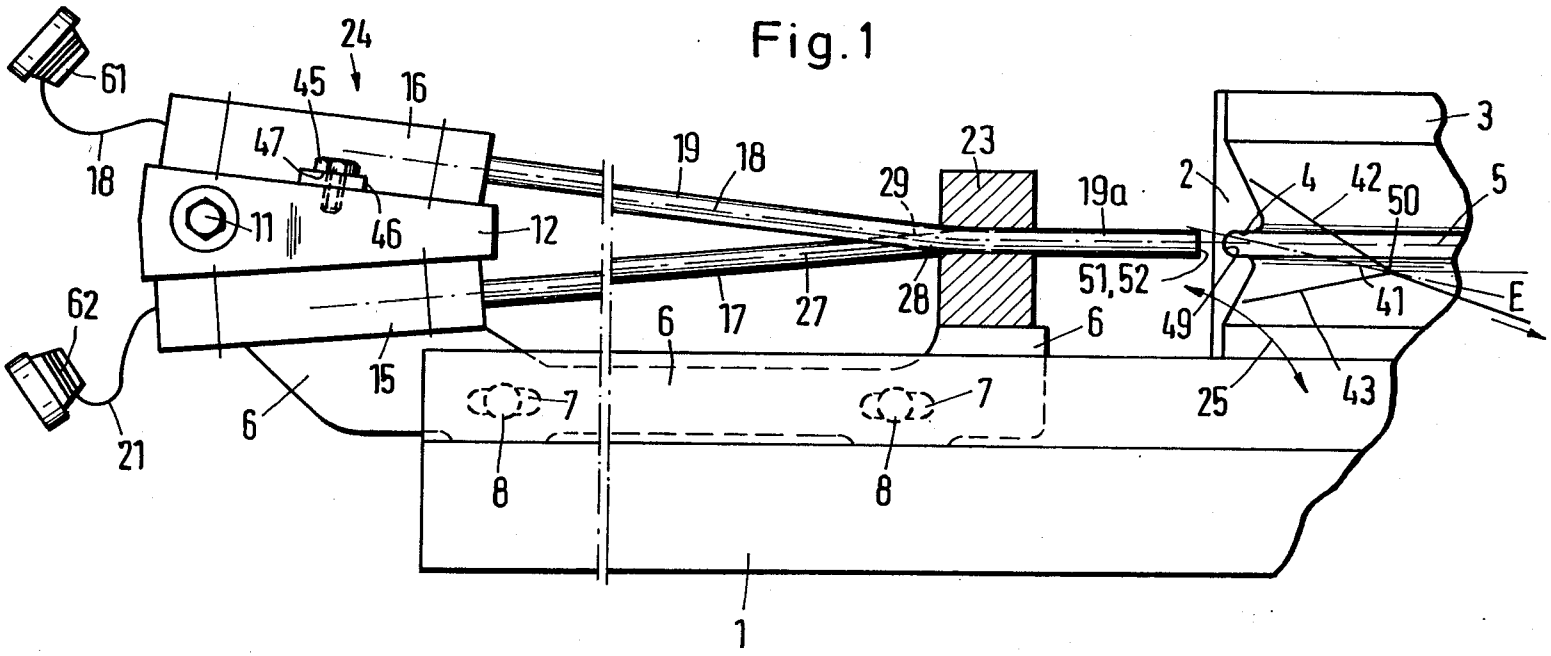
FIG. 1 is a front view, partially in perspective, of a first embodiment of the inventive weft insertion nozzle arrangement.

Describing now the drawings, it is to be understood that only enough of the construction of the weft insertion nozzle arrangement and that of the air jet weaving machine have been shown as needed for those skilled in the art to readily understand the underlying principles and concepts of the present development, while simplifying the showing of the drawings. Turning attention now specifically to FIG. 1 of the drawings, there has been illustrated, partially in perspective, a first exemplary embodiment of the inventive weft thread or weft insertion nozzle arrangement in an air jet weaving machine. At a batten or sley 1 of the air jet weaving machine there is mounted a reed 3 containing profiled lamellae 2. The lamellae 2 collectively define a weft insertion tunnel or channel 4 within which there is situated a weft insertion line 5.

A carrier or support 6 is adjustably and fixedly positionably connected with the batten or sley 1 at an end thereof which is the left-hand end in FIG. 1, by means of a bolt or screw-type connection 8 and slots 7. Due to such connection there can be varied the distance C between the outflow or discharge ends 51 and 52 of the hereinafter to be described weft insertion nozzles 15 and 16, respectively, from the weaving shed 41.

A block 12 is mounted at the carrier or support 6 by means of a bolt 11 or any other suitable mounting element. Two weft insertion nozzles are fixedly mounted at this block 12. The two weft insertion nozzles are designated in their entirety by reference characters 15 and 16. One weft insertion nozzle 15 is associated with a mixing tube 17 having a substantially circular round cross-section. A weft thread 21 extends through the weft insertion nozzle 15 and its associated mixing tube 17 and is indicated in FIG. 1 by dash-dotted lines. A weft thread 18 of a different sort, for example, of a different color, is provided for a weft insertion operation in the other weft insertion nozzle 16 and the associated mixing tube 19 thereof. This different type or sort of weft thread 18 is indicated by broken lines in FIG. 1. The weft threads 18 and 21 are withdrawn from respective weft thread buffer storage devices 61 and 62.

Figure 2:
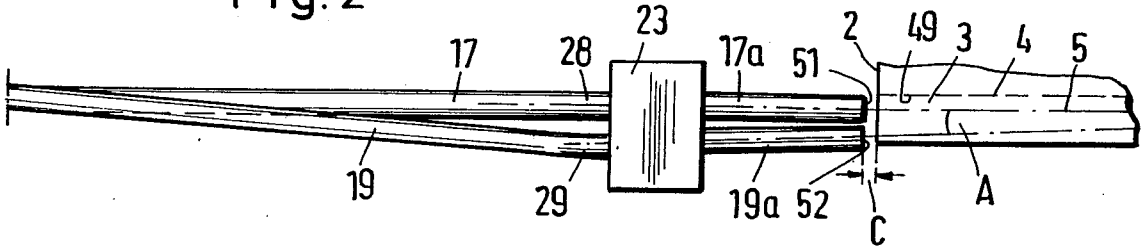
FIG. 2 is a top plan view of the weft insertion nozzle arrangement shown in FIG. 1 and wherein some parts thereof have been omitted in such FIG. 2 to enhance the clarity of illustration.
Figure 3:
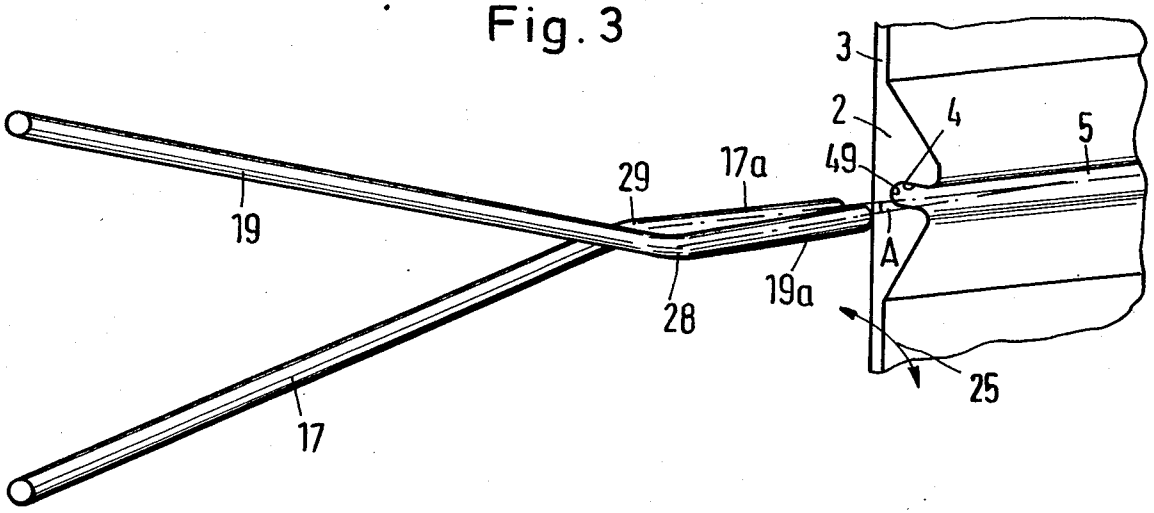
FIG. 3 is a perspective illustration of the part of the weft insertion nozzle arrangement shown in FIG. 2.

The free end or end region 17*a* of the mixing tube 17 associated with the one weft insertion nozzle 15 has a substantially circular round cross-section and is set or positioned parallel to the weft insertion line 5 which is particularly evident from FIG. 2. The free end 19*a* of the mixing tube 19 associated with the other weft insertion nozzle 16 also has a substantially circular round cross-section and is set or extends at an inclination angle A of about 3° relative to the weft insertion line 5. The two free ends or end regions 17*a* and 19*a* of the mixing tubes 17 and 19, respectively, are appropriately held or supported by guide means 23. The two outflow or discharge openings 51 and 52 formed at the respective free ends or end regions 17*a* and 19*a* generally are arranged as closely as possible to each other and preferably contact each other. By means of a bolt or screw-type connection 45 the angle A can be varied or adjusted. This bolt or screw-type connection 45 contains a flange 46 which is mounted at the weft insertion nozzle 16 and which contains a slot or gap 47 extending normally to the drawing plane of FIG. 1.

During operation of the air jet weaving machine containing the weft insertion nozzle arrangement as described hereinbefore, the batten or sley 1 and the reed 3 as well as the entire weft insertion nozzle arrangement generally designated by reference numeral 24, are reciprocated or moved to-and-fro as indicated by the double-headed arrow 25. Due to such reciprocating movement the weft threads 18 and 21 are inserted into the weaving shed 41, which is formed by warp threads 42 and 43, in accordance with a predetermined weft insertion program, for example, in an alternating fashion.

Figure 4:
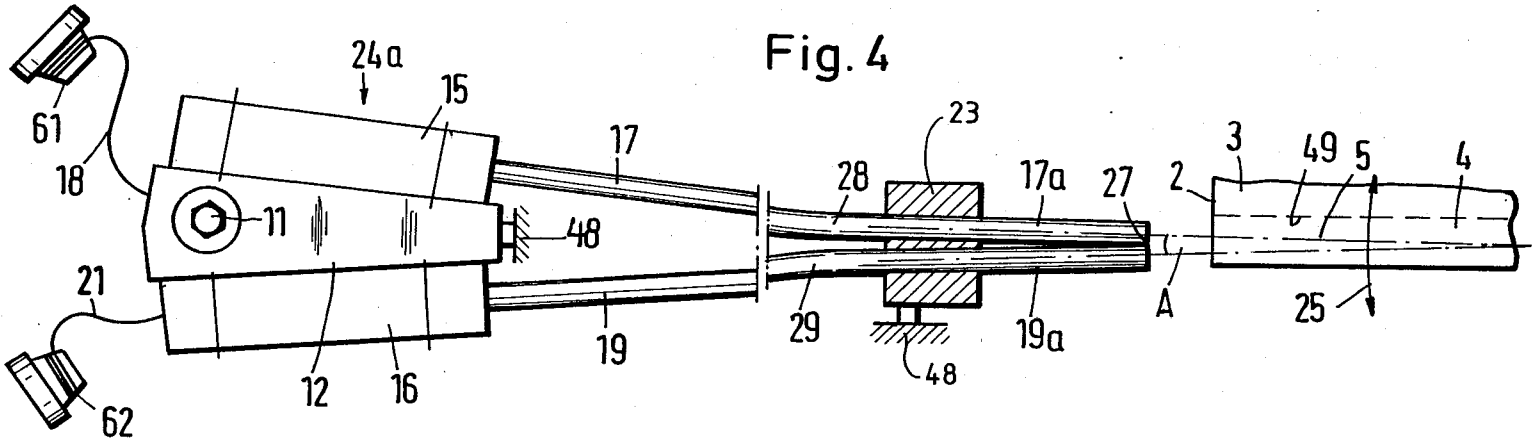
FIG. 4 is a top plan view of a second embodiment of the inventive weft insertion nozzle arrangement.
Figure 5:
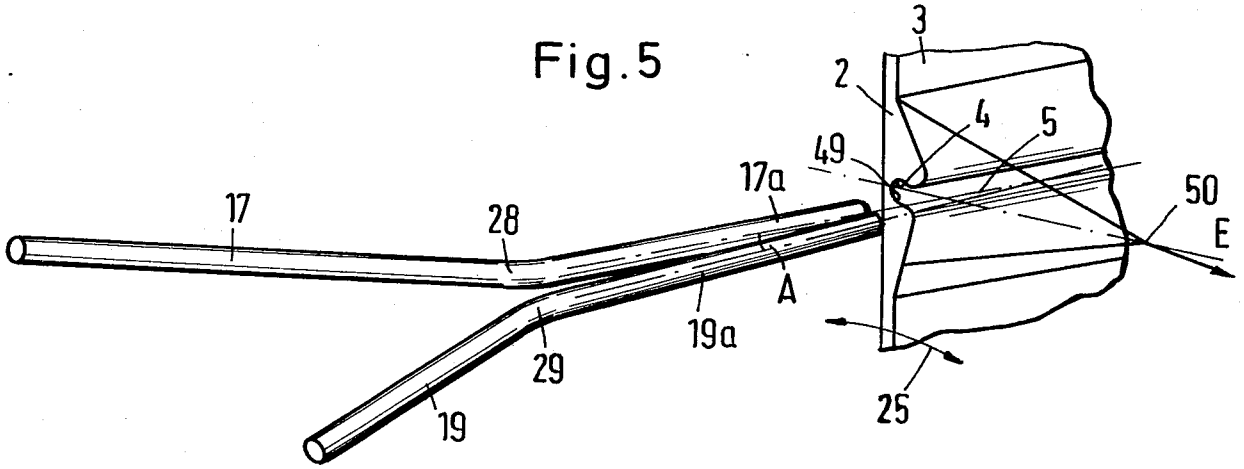
FIG. 5 is a perspective illustration of the essential components of the weft insertion nozzle arrangement shown in FIG. 4.

In the second exemplary embodiment of the inventive weft insertion nozzle arrangement 24*a* in an air jet weaving machine and which is illustrated in FIGS. 4 and 5, the block 12 and the guide means 23 are fixedly connected to a frame 48 of the air jet weaving machine. The block 12 contains the weft insertion nozzle arrangement 24*a* which, in this case, is not reciprocated conjointly with the reed 3 during the weaving operation. Again the weft insertion nozzles 15 and 16 form therebetween an angle A of about 3° i.e. the end region 17*a* of the one weft insertion nozzle 15 extends substantially parallel to the weft insertion line 5 and the end region 19*a* of the other weft insertion nozzle 16 encloses an angle of about 3° with such weft insertion line 5.

In the first and second exemplary embodiments of the inventive weft insertion nozzle arrangements illustrated in FIGS. 1 to 5, the mixing tube 19 associated with the weft insertion nozzle 16 and containing the free end or end region 19*a* is directed in such a manner, i.e. at such an inclination angle A that the mixing tube 19 blows air toward the bottom or base 49 of the tunnel or channel 4 at an inclination of about 3°. This angle A is formed within a horizontal plane which is indicated in FIG. 1 by a dash-dotted line designated by the reference character E. This plane E extends through the cloth or fabric fell 50 and through the bottom or base 49 of the tunnel or channel 4, i.e. parallel to the planes of the drawings of FIGS. 2 and 4.

Figure 6:
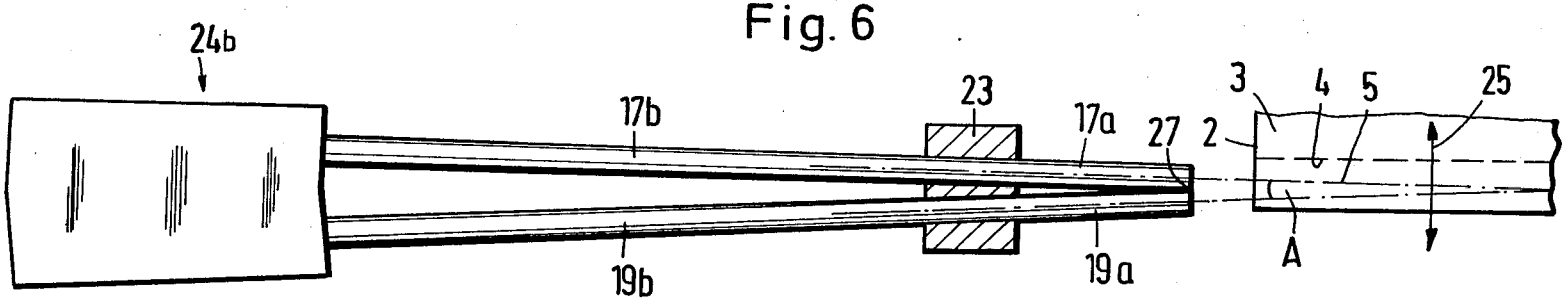
FIG. 6 is a top plan view of a third embodiment of the inventive weft insertion nozzle arrangement.

A third exemplary embodiment of the inventive weft thread or weft insertion nozzle arrangement 24*b* is illustrated in FIG. 6. In this embodiment the two mixing tubes 17*b* and 19*b* are of essentially straight construction in contrast to the mixing tubes 17 and 19 of the first and second embodiments which are illustrated in FIGS. 1 to 5 and which are respectively bent at the locations designated by the reference characters 28 and 29.

Figure 7:
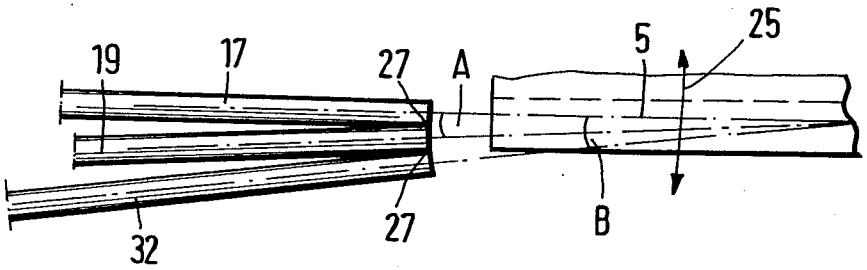
FIG. 7 is a top plan view of a fourth embodiment of the inventive weft insertion nozzle arrangement.

In the fourth exemplary embodiment of the inventive weft insertion nozzle arrangement shown in FIG. 7 there is illustrated a triple weft insertion mechanism containing a third weft insertion nozzle associated with a mixing tube 32. This mixing tube 32 is inclined at a somewhat greater angle B of about 4° relative to the weft insertion line 5. All of the three mixing tubes 17, 19 and 32 of the three weft insertion nozzles are arranged in a substantially horizontal plane which extends through the cloth or fabric fell 50 and through the bottom or base 49 of the tunnel or channel 4, i.e. parallel to the drawing plane of FIG. 7.

In all of the aforedescribed embodiments of the inventive weft insertion nozzle arrangements the end or end region 17*a* of the mixing tube 17 is set or positioned substantially parallel to the weft insertion line 5 at least in the weft insertion position of the components or in each position thereof, i.e. even during the movement of the reed 3 towards the cloth or fabric fell 50. The end or end region 19*a* of the mixing tube 19 is set or positioned at the inclination angle A relative to the end or end region 17*a* of the mixing tube 17 i.e. relative to the weft insertion line 5.

In a further modified and not particularly illustrated embodiment of the inventive weft insertion nozzle arrangement there is employed, instead of the tunnel or channel reed, a reed containing non-profiled, straight lamellae. In an air jet weaving machine containing such type of reed the weft insertion tunnel or channel is formed by guide teeth which are positioned in front of the reed and into which the weft insertion nozzles 15 and 16 or their respective ends or end regions 17*a* and 19*a* blow air. The weft insertion line 5 then extends within the aforementioned guide teeth.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A weft insertion nozzle arrangement arranged at a predetermined member of an air jet weaving machine forming a weaving shed which defines a predeterminate weft insertion line, comprising:

at least two weft insertion nozzles arranged outside said weaving shed and each said weft insertion nozzle including a respective mixing tube;

the respective mixing tube of said at least two weft insertion nozzles defining at least two mixing tubes for inserting a respective weft thread each generally along said predeterminate insertion line defining a substantially common weft insertion line for said at least two mixing tubes;

each mixing tube of each said weft insertion nozzle containing an end region defining an outflow opening facing said weaving shed and spaced at a predetermined distance therefrom in the general direction of said substantially common weft insertion line for inserting the weft thread issuing from the outflow opening of each said mixing tube into said weaving shed in said general direction of said substantially common weft insertion line;

means for fixedly mounting said weft insertion nozzle arrangement comprising said at least two weft insertion nozzles and said at least two mixing tubes at said predetermined member of said air jet weaving machine member;

said at least two weft insertion nozzles including said mixing tubes assuming a weft insertion position wherein said end region and outflow opening of each of said at least two mixing tubes are oriented in the general direction of said substantially common weft insertion line; and at least in said weft insertion position, said end region of one of said at least two mixing tubes being set substantially parallel to said substantially common weft insertion line and the end region of an other one of said at least two mixing tubes being set at a small angle of inclination relative to said substantially common weft insertion line.

2. The weft insertion nozzle arrangement as defined in claim 1, wherein:

said other one of said end region of the at least two mixing tubes is set relative to said weft insertion line at an angle in the range of about 1° to about 5°.

3. The weft insertion nozzle arrangement as defined in claim 1, wherein:

said weft insertion nozzle arrangement being arranged at a sley defining said predetermined member of said air jet weaving machine and being reciprocatingly pivotable conjointly with said sley during operation of said air jet weaving machine; and said sley being defined by said air jet weaving machine member.

4. The weft insertion nozzle arrangement as defined in claim 1, wherein:

said weft insertion nozzle arrangement being arranged at a frame defining said predetermined member of said air jet weaving machine and being fixedly connected to said air jet weaving machine frame; and said frame being defined by said air jet weaving machine member.

5. The weft insertion nozzle arrangement as defined in claim 1, wherein:

said means for fixedly mounting said weft insertion nozzle arrangement including structure for adjustably and fixedly positioning at least one of said at least two weft insertion nozzles including its related mixing tube relative to an other one of said at least two weft insertion nozzles including its related mixing tube such that a variable angle is formed between said at least one adjustable and fixedly positionable weft insertion nozzle including its related mixing tube and said other one of said at least two weft insertion nozzles including its related mixing tube.

6. The weft insertion nozzle arrangement as defined in claim 1, wherein:

said means for fixedly mounting said weft insertion nozzle arrangement including structure for adjustably and fixedly positionably mounting said weft insertion nozzle arrangement at said predetermined member of said air jet weaving machine member and for mounting said weft insertion nozzle arrangement such that at least the distance between said at least two weft insertion nozzles including their related mixing tubes and said weaving shed is adjustable.

7. The weft insertion nozzle arrangement as defined in claim 1, wherein:

said at least two weft insertion nozzles extending in a first coplanar relationship; and said end regions of said at least two mixing tubes extending in a second coplanar relationship transverse to said first coplanar relationship.

8. The weft insertion nozzle arrangement as defined in claim 1, further including:

a weft insertion tunnel including a base and through which weft insertion tunnel there extends said substantially common weft insertion line;

said end regions of said at least two mixing tubes defining respective axes thereof; and one axis of said respective axes of said end regions of said at least two mixing tubes being arranged substantially parallel with respect to the weft insertion tunnel and one further axis of said respective axes of said end regions of said at least two mixing tubes being set at a small angle of inclination relative to said base of the weft insertion tunnel.

9. An air jet weaving machine forming a weaving shed and comprising:

a weft insertion nozzle arrangement containing at least two weft insertion nozzles;

an air jet weaving machine member at which said weft insertion nozzle arrangement is arranged and each said weft insertion nozzle including a respective mixing tube;

said at least two weft insertion nozzles including said respective mixing tube thereof being arranged outside said weaving shed and the respective mixing tube of said at least two weft insertion nozzles defining at least two mixing tubes each serving to insert a selected weft thread along a weft insertion line defining a substantially common weft insertion line for said at least two mixing tubes;

each said weft insertion nozzle containing an end region with an outflow opening facing said weaving shed and spaced therefrom at a predetermined distance in the general direction of said substantially common weft insertion line;

means for fixedly mounting said weft insertion nozzle arrangement comprising said at lesat two weft insertion nozzles and said at least two mixing tubes at said air jet weaving machine member;

said at least two weft insertion nozzles including said mixing tubes assuming a predetermined weft insertion position wherein said end region and outflow opening of each of said at least two mixing tubes are oriented in the general direction of said substantially common weft insertion line; and at least in said predetermined weft insertion position of said at least two weft insertion nozzles including said mixing tubes, said end region of one of said at least two mixing tubes being set substantially parallel to said substantially common weft insertion line and the end region of an other one of said at least two mixing tubes being set at a small angle of inclination relative to said substantially common weft insertion line.

10. The air jet weaving machine as defined in claim 9, wherein:

said end region of the other one of said at least two mixing tubes is set relative to said weft insertion line at an angle in the range of about 1° to about 5°.

11. The air jet weaving machine as defined in claim 9, further including:

a sley reciprocatingly pivotable during operation of said air jet weaving machine;

said sley constituting said air jet weaving machine member at which said weft insertion nozzle arrangement is arranged; and said weft insertion nozzle arrangement being reciprocatingly pivotable conjointly with said sley during operation of said air jet weaving machine.

12. The air jet weaving machine as defined in claim 9, further including:

an air jet weaving machine frame; and said air jet weaving machine frame constituting said air jet weaving machine member at which said weft insertion nozzle arrangement is arranged.

13. The air jet weaving machine as defined in claim 9, wherein:

said means for fixedly mounting said weft insertion nozzle arrangement including structure for adjustably and fixedly positioning at least one of said at least two mixing tubes relative to an other one of said at least two mixing tubes such that a variable angle is formed between said end region of said at least one mixing tube and said end region of the other one of said at least two mixing tubes.

14. The air jet weaving machine as defined in claim 9, wherein:

said means for fixedly mounting said weft insertion nozzle arrangement including structure for adjustably and fixedly positionably mounting said weft insertion nozzle arrangement at said air jet weaving machine member at which said weft insertion nozzle arrangement is arranged such that at least said predetermined distance of said outflow openings of said end regions of the at least two mixing tubes from said weaving shed is variable.

* * * * *

UNITED STATES PATENT AND TRADEMARK OFFICE

CERTIFICATE OF CORRECTION

PATENT NO. : 4,669,514

DATED : June 2, 1987

INVENTOR(S) : PETRUS G. J. MANDERS

It is certified that error appears in the above-identified patent and that said Letters Patent is hereby corrected as shown below:

Title page, in the Abstract, line 4, after "end" (first occurrence), please delete "of" and insert --or--

Column 1, line 44, (Summary of the Invention, line 3), before "invention" please insert --present--

Signed and Sealed this

Second Day of February, 1988

*Attest:*

DONALD J. QUIGG

*Attesting Officer*

*Commissioner of Patents and Trademarks*